US010766582B2

(12) United States Patent
Kerr et al.

(10) Patent No.: US 10,766,582 B2
(45) Date of Patent: Sep. 8, 2020

(54) VESSEL SUPPORTING APPARATUS

(71) Applicant: Devonport Royal Dockyard Limited, Devonport, Plymouth (GB)

(72) Inventors: George Kerr, Devonport (GB); Mark Lakeman, Devonport (GB); Doug Milne, Devonport (GB)

(73) Assignee: Devonport Royal Dockyard Limited, Devonport, Plymouth (GB)

( * ) Notice: Subject to any disclaimer, the term of this patent is extended or adjusted under 35 U.S.C. 154(b) by 0 days.

(21) Appl. No.: 16/312,205

(22) PCT Filed: Jun. 28, 2017

(86) PCT No.: PCT/EP2017/066019
§ 371 (c)(1),
(2) Date: Dec. 20, 2018

(87) PCT Pub. No.: WO2018/002152
PCT Pub. Date: Jan. 4, 2018

(65) Prior Publication Data

US 2019/0233066 A1 Aug. 1, 2019

(30) Foreign Application Priority Data

Jun. 29, 2016 (GB) ..... 1611318.5

(51) Int. Cl.
*B63C 5/04* (2006.01)

(52) U.S. Cl.
CPC ..... *B63C 5/04* (2013.01)

(58) Field of Classification Search
CPC ..... B63C 5/04
See application file for complete search history.

(56) References Cited

U.S. PATENT DOCUMENTS 4,227,828 A * 10/1980 Ivanov ..... B63C 5/04 114/65 R

FOREIGN PATENT DOCUMENTS

| | | | |
|---|---|---|---|
| JP | 53-046717 | Y | 11/1978 |
| JP | 55-032318 | Y | 8/1980 |
| JP | 59-132496 | U1 | 9/1984 |
| JP | 59-132497 | U1 | 9/1984 |
| JP | 02-099088 | U1 | 8/1990 |
| JP | 2010-167800 | A | 8/2010 |
| JP | 2011-178387 | A | 9/2011 |

(Continued)

OTHER PUBLICATIONS

"Anchoring, Mooring, Towing, Berthing, Launching, Recovery and Docking," Lloyd's Register, Rules and Regulations for the Classification of Naval Ships, vol. 1, Part 3, Chap. 5, Sections 8, 9 & 10, Jan. 2015, pp. 13-15.

(Continued)

*Primary Examiner* — Stephen P Avila
(74) *Attorney, Agent, or Firm* — Christensen O'Connor Johnson Kindness PLLC

(57) ABSTRACT

A support structure for supporting a vessel. The support structure includes a pair of support blocks mounted one on top of the other with a reconfigurable intermediate operating layer in between. The intermediate operating layer can be operable to adjust a separation between the support blocks, permit relative lateral movement between the support blocks and act as a load bearing structure.

19 Claims, 4 Drawing Sheets

(56) References Cited

FOREIGN PATENT DOCUMENTS

KR 10-2013-0011018 A 1/2013

OTHER PUBLICATIONS

Search Report Under Section 17(5), dated Nov. 28, 2016, in Application No. GB1611318.5, filed Jun. 29, 2016, 3 pages.
Sea Systems Controllerate Publication No. 23 (SSCP23), vol. 1, "Design of Surface Ship Structures," pp. 4.11-4.12 (1989).
International Search Report and Written Opinion dated Sep. 14, 2017, issued in corresponding International Application No. PCT/EP2017/066019, filed Jun. 28, 2017, 11 pages.

* cited by examiner

VESSEL SUPPORTING APPARATUS

FIELD OF THE INVENTION

The invention relates to structures for supporting vessels. In particular, the invention relates to removable support structures that permit access to the whole undersurface of a vessel when in dry dock.

BACKGROUND TO THE INVENTION

A dry dock is a channel shaped to receive a maritime vessel (e.g. ship or submarine). The channel can be flooded to enable the vessel to enter. The channel can then be drained to expose parts of the vessel that are normally underwater. The dry dock is provided with a platform or other structure to support the vessel in the absence of water in the channel. A dry dock may be used for refitting or other types maintenance or testing, especially where it is desirable to have access to the undersurface (e.g. keel) of the vessel.

FIG. 1 shows side and end views of an example of conventional dock furniture 100 used to support a maritime vessel in dry dock. The dock furniture 100 comprise a support stack (also referred to herein as a support block) comprise a number of different components mounted on one another. At the base of the stack is a dock block 18, which may be referred to herein as a Type 1 dock block, which has a standard shape and structural properties. The dock block 18 is a reinforced concrete structure for with a steel top surface and side holes to provide access for a lifting tool (such as a forklift). Mounted on each dock block 18 is a pair of steel wedges 16 and a plurality of layers of timber 14 (typically oak) provided to ensure the stack has the required height. Each layer of timber may comprise a plurality of elongate planks that lie adjacent one another. A softwood capper layer 10 is on the top of the stack to provide a compliant surface for abutting the vessel.

In practice a vessel is supported on a plurality of the support stacks like those shown in FIG. 1.

When any vessel is docked, the support blocks on which she sits obstruct part of the keel, preventing access for survey and painting. The problem is normally solved with one of two approaches:

1. Providing two docking support configurations, i.e. two sets of different locations for the support blocks to contact the keel, which means that different parts of the keel are covered depending on the configuration used.

2. Removing a subset of the support blocks whilst the vessel is docked is used. For example, the docking support configuration may be arranged to permit up to a fifth of the support blocks to be removed at a time.

In the first approach, the docking of a vessel can be carried out in two phases. During the first phase, the vessel is positioned on the support blocks in a first configuration to permit work to take place on exposed parts of the bottom. For example, the exposed surface may be surveyed, blasted and painted. Phase one is complete when all the works in the exposed parts of the bottom have been finished. In phase two, the dock is flooded and the vessel repositioned on the support blocks in a second configuration. For example, the vessel may be fleeted forward by the distance of one block spacing. The dock is then drained again and the remainder of the bottom can be accessed. Phase two may not necessary occur immediately after phase one. For example, the second configuration may be used the next time the vessel is docked.

In the second approach, removal of a support block is done by extracting the steel wedges 16 from the top surface of the dock block 18, which then allows the layers of timber 14 to be dismantled. However, the wedges and the steel surfaces which they bear on corrode easily and over a short period of use the surfaces can become uneven due to flaking corrosion. This makes the wedges difficult to remove. When this happens, it is necessary to split out the wood whilst it is still under load. This can be a time consuming process.

SUMMARY OF THE INVENTION

At its most general, the invention provides a support stack that facilitates removal. The support stack comprises a pair of support blocks mounted one on top of the other with a reconfigurable intermediate operating layer in between. The intermediate operating layer can be operable to adjust a separation between the support blocks, permit relative lateral movement between the support blocks and act as a load bearing structure. These three functions facilitate efficient installation and removal of the support block, which allows them to be manipulated in a significantly reduced timescale compared with the traditional methods.

According to one aspect of the invention there is provided support structure comprising: a base support block; an upper support block mounted on an upper surface of the base support block via an intermediate operating layer; a compressible contact layer supported on an upper surface of the upper support block; a height adjustment mechanism mountable in the intermediate operating layer; and a rigid spacer mountable in the intermediate operating layer; wherein the intermediate operating layer is adjustable between: a load bearing configuration in which the rigid spacer is mounted in the intermediate operating layer to transfer a load on the upper support block to the base support block, an intermediate configuration in which the height adjustment mechanism is mounted in the intermediate operating layer and operable to lift the upper support block to introduce a clearance gap that permits insertion and removal of the rigid spacer. The support structure may be a dry dock vessel support structure.

In order to form the clearance gap, the contact layer may be compressed by the additional pressure exerted by the height adjustment mechanism. Accordingly, the position of the vessel may be substantially unchanged despite relative movement of the upper support block. The compression may be reversible, whereby the intermediate configuration is also used to insert the rigid spacer when installed the support structure. Thus, by suitable selection of the properties of the compressible contact layer, the support structure can operate to vary the vertical height of the intermediate operating layer whilst supporting a load.

The intermediate operating layer is reconfigurable in the sense that the rigid spacer and height adjustment mechanism may be removed when not in use in any particular configuration. Thus, the height adjustment mechanism can be removed in the load bearing configuration, in order to avoid it from being damaged by the maintenance processes carried out on the undersurface of the vessel.

The height adjustment mechanism may be configured to bear the load on the upper support block in the intermediate configuration. In other words, the intermediate configuration can be entered whilst a vessel is in place on the support structure. An advantage of the invention may be that the support structures can be replaced at very close to their original loading. Using the traditional method, blocks that were removed later in the removal sequence became progressively more loaded, making them even harder to remove.

The support structure may be use existing dock furniture, e.g. the Type 1 support blocks discussed above, for the base support block and upper support block. The Type 1 block may be used in an inverted orientation for the upper support block. Thus, the base support block and/or the upper support block may comprise a cuboidal mass of reinforced concrete with a plated surface (e.g. a steel plate or the like) at an interface with the intermediate operating layer. The base support block and upper support block need to have the strength and durability associated with conventional dock furniture, i.e. the ability to support the loads associated with dry dock use and survive repeated submersion in sea water.

However, it may be desirable for the support structure of the invention to use support blocks that have a higher load capacity than conventional support blocks. This may enable hydrostatic testing of tanks to be performed whilst the vessel is in dry dock. In order to be compatible with existing dock furniture, it may be desirable for the higher load capacity support blocks to have substantially the same dimensions and weight as a conventional (e.g. Type 1) support block. In one example, this is achieved by fabricating the support block from a metal (e.g. steel) that exhibits the physical properties (in particular strength under compression) required. The support block may thus be formed from a plurality of rolled metal plates that are connected to form a block shape. In one example, the base support block and/or the upper support block may comprise: a lower plate that forms the bottom surface of the block; an upper plate that forms the top surface of the block; and a load bearing frame that connects the lower plate to the upper plate. The lower plate, upper plate and load bearing frame may be formed from steel. The lower plate and upper plate may have a width of 1.0 m and a length of 1.8 m. The support block may have a load capacity equal to or greater than 200 tonnes, preferably equal to or greater than 300 tonnes, and more preferably at least 400 tonnes.

The base support block and upper support block may have substantially the same size and weight. This can ensure that support structure is stable in the stacked configuration. To assist in preserving this stability, the components that are mountable in the intermediate operating layer may be arranged to have a flat profile. For example, the height adjustment mechanism may comprises hydraulic jacks that present a relatively large area footprint on both the base support layer and upper support layer. The height adjustment mechanism itself may be selected to minimise the normal vertical separation of the base support layer and upper support layer.

The contact layer may be formed from a material that is resiliently compressible under the expected range of pressures that it will experience in normal use. The contact layer may be a variable surface area in order to ensure that it operates in a pressure range where it is resiliently compressible. For example, the contact layer may comprise a plurality of selectively removable modular elements. In one example, the material of the contact layer is softwood. The modular elements may be planks or the like that are securable to the upper support block.

The height adjustment mechanism may comprise one or more jacking assemblies. For example, the height adjust mechanism may comprise a series of jacking assemblies mountable laterally along the intermediate operating layer, the jacking assemblies having a combined load capacity equal to or greater than a load capacity of the support structure in the load bearing configuration. Each jacking assembly may comprise one or more hydraulic jacks.

The support structure may comprise a lateral movement mechanism mountable in the intermediate operating layer, wherein, in the removal configuration, the lateral movement mechanism is mounted in the intermediate operating layer and the upper support block is operably connected to the lateral movement mechanism to permit relative lateral movement between the upper support block and base support block. Similarly to the height adjustment mechanism and rigid spacer, the lateral movement mechanism may be removed from the intermediate operating layer when not required.

The lateral movement mechanism may be operable to facilitate manual sliding of the upper support block relative to the base support block. In one example, the lateral movement mechanism may comprise a set of rollers secured to the base support block. The set of rollers may comprise a pair of laterally extending roller tracks mountable at opposite sides of a top surface of the base support block.

The support structure may comprise a storage table positionable laterally adjacent the base support block to receive the upper support block during relative movement between the upper support block and base support block in the removal configuration. In other words, the upper support block can slide off the base support block on to the storage table. The storage table may include rollers or the like on its top surface to facilitate positioning of the upper support block thereon. The storage table may be length adjustable legs to enable the top surface of the storage table to be aligned level with the top surface of the base support block.

The rigid spacer may be a modular spacer system, e.g. comprising a plurality of rigid struts that can be independently locatable in the intermediate operating layer. This may enable the rigid struts to be mounted using manually or using conventional lifting equipment. Each rigid strut has a construction capable of bearing a load from the upper support block in use (i.e. when a vessel is present). For example, each rigid strut may comprise a cuboidal box having a hollow section.

Similarly to the conventional support structure, there may be one or more intermediate timber layers between the upper support block and the contact layer, e.g. to enable the height of the support structure to be adjusted for different regions at the undersurface of the vessel.

In another aspect of the invention, there is provided a method of introducing a support structure beneath a vessel, the support structure comprising: a base support block; an upper support block mountable on an upper surface of the base support block via an intermediate operating layer; a compressible contact layer supported on an upper surface of the upper support block; a height adjustment mechanism mountable in the intermediate operating layer; and a rigid spacer mountable in the intermediate operating layer, the method comprising: locating the base support block beneath a location on an undersurface of the vessel that is to be contacted by the support structure; mounting the height adjustment mechanism in the intermediate operating layer on the base support block; positioning the upper support block in a mounting position on the base support block; operating the height adjustment mechanism to lift the upper support block into contact with the undersurface of the vessel and introduce a separation distance between the base support block and upper support block for receiving the rigid spacer; inserting the rigid spacer into the intermediate operating layer; operating the height adjustment mechanism to lower the upper support block on to the rigid spacer, whereby the rigid spacer transfers a load on the upper support block to the base support block. Any one or more features of the support structure discussed above may be used in this aspect of the invention.

The step of lifting the upper support block into contact with the undersurface of the vessel may include transferring a load from the vessel onto the height adjustment mechanism and compressing the contact layer. The contact layer may be resiliently compressed by 1 to 2 mm to extend a spacing between the base support block and upper support block to facilitate insertion of the rigid spacer.

Upon lowering the upper support block on to the rigid spacer, the compression in the contact layer may be reversed.

Positioning the upper support block in a mounting position on the base support block may comprise: mounting a lateral movement mechanism in the intermediate operating layer on the base support block; locating the upper support block laterally adjacent to its mounting position on the base support block; operably connecting the upper support block to the lateral movement mechanism; and moving the upper support block laterally relative to the base support block into its mounting position on the base support block.

In a further aspect of the invention, there is provided a method of removing a support structure from beneath a vessel, the support structure comprising: a base support block; an upper support block mounted on an upper surface of the base support block via an intermediate operating layer; a compressible contact layer supported on an upper surface of the upper support block; a height adjustment mechanism mountable in the intermediate operating layer; and a rigid spacer mounted in the intermediate operating layer to transfer a load from the vessel on the upper support block to the base support block, the method comprising: mounting the height adjustment mechanism in the intermediate operating layer on the base support block; operating the height adjustment mechanism to lift the upper support block into contact with the undersurface of the vessel and introduce a clearance gap above the rigid spacer; removing the rigid spacer from the intermediate operating layer; operating the height adjustment mechanism to lower the upper support block and create a gap between the contact layer and the undersurface of the vessel; and moving the upper support block relative to the base support block away from its mounting position on the base support block. Any one or more features of the support structure discussed above may be used in this aspect of the invention.

The step of lifting the upper support block into contact with the undersurface of the vessel may include transferring a load from the vessel onto the height adjustment mechanism and compressing the contact layer. The contact layer may be resiliently compressed by 1 to 2 mm to create the clearance gap for removing the rigid spacer.

The method may include mounting a lateral movement mechanism in the intermediate operating layer on the base support block, wherein operating the height adjustment mechanism to lower the upper support block comprises operably connecting the upper support block with the lateral movement mechanism.

BRIEF DESCRIPTION OF THE DRAWINGS

Embodiments of the invention are described below with reference to the accompanying drawings, in which.

DETAILED DESCRIPTION; FURTHER OPTIONS AND PREFERENCES

Figure 2:
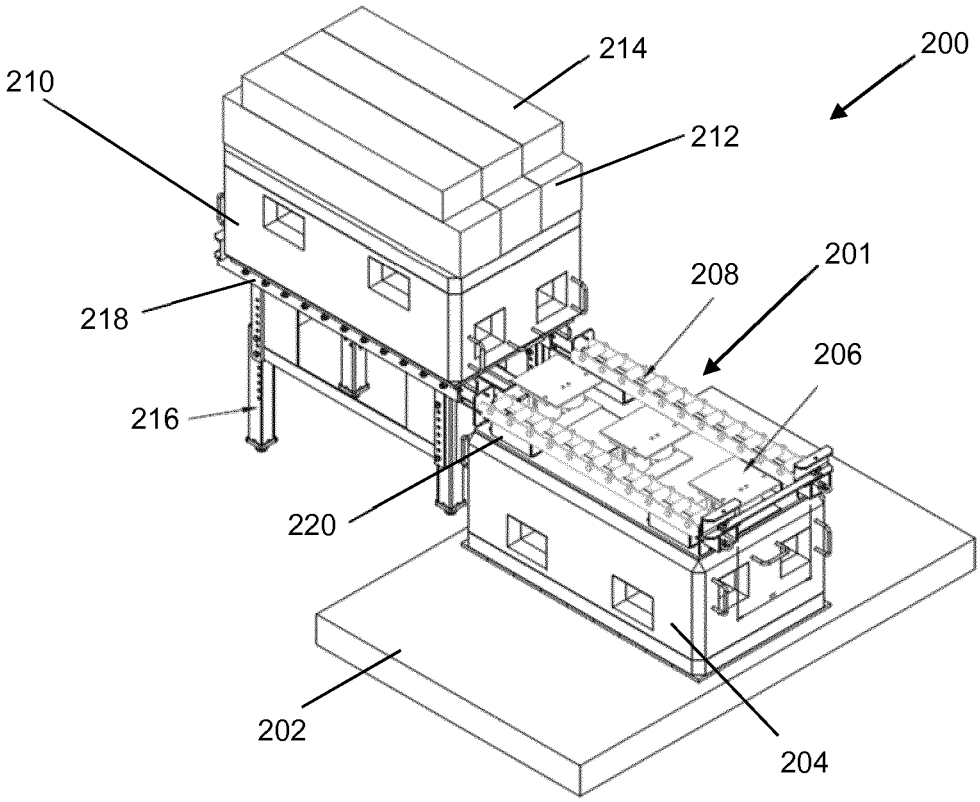
FIG. 2 is a perspective view of a dry dock vessel supporting apparatus that is a first embodiment of the invention.

FIG. 2 is a perspective view of a dry dock support structure 200 that is an embodiment of the invention.

The support structure 200 comprises a stacked set of components that includes an intermediate operating layer 201 that can support both a height adjustment mechanism and a lateral movement mechanism to facilitate disengagement and removal of upper layers of the support structure 200.

The support structure comprises a base support block 204 that rests of the floor 202 or main platform of the dry dock in a conventional manner. As discussed below, the base support block 204 may be a Type 1 support block as described above, or it may be a specifically designed unit. The invention is thus capable of implementation with known elements of dock furniture.

The intermediate operating layer 201 is provided on the base support block. The intermediate operating layer may have three components: a removable rigid spacer (not shown in FIG. 2), a lateral movement mechanism (e.g. a pair of roller tracks 208), and a height adjustment mechanism (e.g. a set of hydraulic jacks 206). The lateral movement mechanism and height adjustment mechanism may be removable, as discussed below. The removable rigid spacer is for maintaining the support structure 200 in an load-bearing configuration in which it is engages with the underside of a vessel. In one example, the rigid spacer may comprise a plurality of blocks that can be individually positioned in the intermediate operating layer.

The intermediate operating layer 201 permit adjustment of the relative position of an upper set of components relative to the base support block 204. The upper set of components comprises an upper support block 210, which may be the same type as the base support block 204. As shown in FIG. 2, the upper support block 210 is a conventional Type 1 block that has been inverted so that its steel covered surface provides a suitable engagement surface for the intermediate operating layer 201. One or more timber layers 212 may be provided one the top surface of the upper support block 210 to give the support structure 200 a desired height. This layer may be optional. One timber layer 212 is illustrated in FIG. 2, but there may be zero, two, three of more timber layers in practice.

Figure 1:
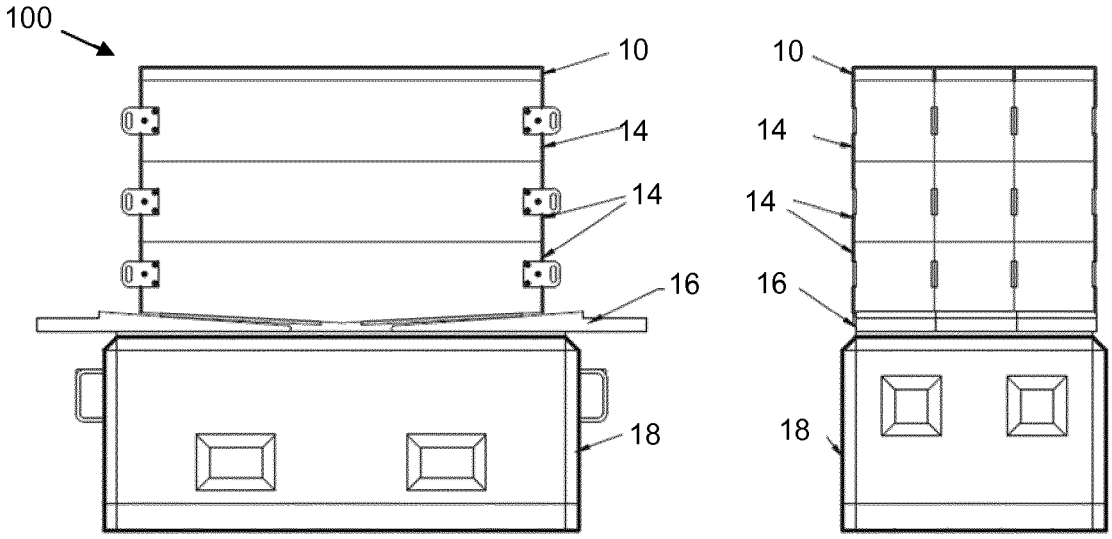
Fig. 1 (Prior Art)
FIG. 1 is a front and side view of a conventional dry dock vessel supporting apparatus, as is described above.

At the top of the upper set of components there is a compressible contact layer 214, which in this embodiment is similar to the softwood capper layer discussed with reference to FIG. 1. The compressible contact layer 214 is configured (i.e. has structural properties and dimensions selected) to retain a level of compressibility in the load direction even when the support structure is in a load bearing configuration with a load from a vessel acting thereon. By retaining a level of compressibility, the contact layer 214 permits the height adjustment mechanism to raise the upper set of component relative to the base block without disturbing the support vessel. This movement, which may be of the order of millimetres, can be enough to facilitate removal of the rigid spacer. The height adjustment mechanism can then lower the upper set of components on to the lateral movement mechanism. The height of the lateral movement mechanism is less than the height of the rigid spacer, so this movement disengages the upper set of components from the vessel and removes the load from the support structure.

In FIG. 2, the support structure 200 is shown in a removed configuration, where the upper set of components is rolled away from the base support block 204. A storage table 216 having a set of rollers 218 mounted thereon can be used to support the upper set of components. The storage table 216 may have length adjustable legs to enable its support surface to be aligned with the intermediate operating layer 201, so there is no step as the upper set of components is removed. The legs may be independently length adjustable so that the support surface can be held level even if the floor of the dry dock is not level.

To aid understanding, FIG. 2 illustrates the key components of the support structure discussed above. In practice, these components will be secured in place using conventional means, such as ratchet straps, tie bars or the like.

To transition between the removed configuration shown in FIG. 2 and the load bearing configuration, the height adjustment mechanism and the lateral movement mechanism are mounted on an upper surface of the base support block 204. The lateral movement mechanism in this example is a pair of roller tracks 208 that are mounted via support feet 220 on opposite lateral sides of the upper surface. The height adjustment structure comprising a plurality of jacks 206 mounted between the roller tracks 208, and is discussed in more detail with reference to FIG. 5 below. The roller tracks 208 may be connected to the support table 216 to prevent relative movement between the table and lateral movement mechanism as the upper set of components is rolled into position above the base support block 204.

During movement of the upper set of components, the height adjustment mechanism is in a lowered configuration that does not interfere with or obstruct movement of the upper set of components. For example, the top surface of the jacks may be located lower than the top surface of the rollers.

When the upper set of components is in position over the base support block 204, the height adjustment mechanism is operated to lift the upper set of components to create a gap suitable for insertion of the rigid spacer and removal of the lateral movement mechanism. During this step, the height adjustment mechanism may remove the load from the lateral movement mechanism, i.e. lift the upper set of components away from the rollers. This step can be carried out when a vessel is in place (e.g. supported by a number of other support structures), so that the height adjustment mechanism also takes on a load from the vessel.

After the rigid spacer is inserted, the height adjustment mechanism can be lowered to transfer the load on to the rigid spacer. The height adjustment mechanism may then be removed.

Figure 3:
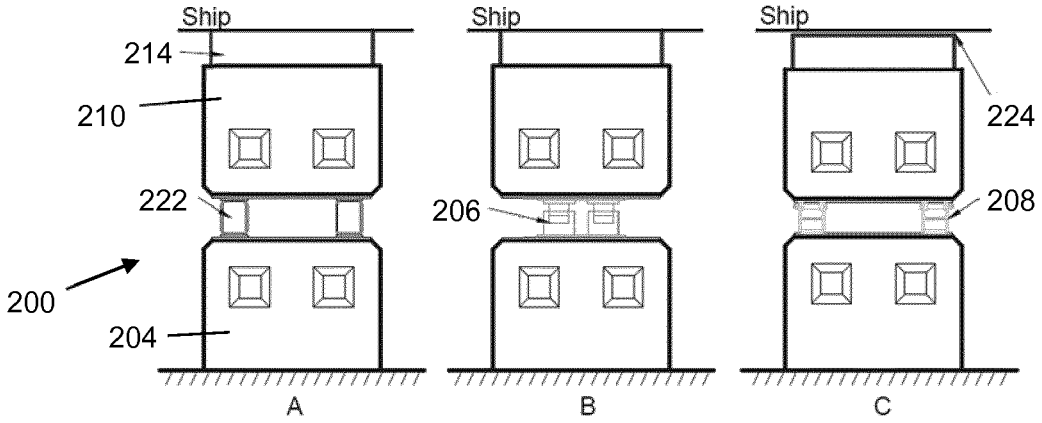
FIG. 3 is a side view of the dry dock vessel supporting apparatus of FIG. 2 shows three steps in a block removal operation.

FIG. 3 shows a schematic side view of the support structure 200 in three stages of operation as described above. The same reference numbers are used to indicate the same components, which are not described again. In the example shown in FIG. 3 there are no timber layers between the upper support block 210 and the compressible contact layer 214.

In stage A of FIG. 3, the support structure 200 is in a load bearing configuration where it supports a ship in contact with the top surface of the contact layer 214. The upper support block 210 and base support block 204 are separated by a rigid spacer, which in this example is a set of rigid stools or struts 222 mounted between opposite sides of the support block. The stools support the upper support block 210 and create the necessary space for installation of the removal mechanism (i.e. lateral movement mechanism and height adjustment mechanism). In this example, the stools are fabricated from steel, and are cuboidal blocks preferably having a laterally extending through hole (e.g. a hollow section) to facilitate removable using an extracting tool. There may be a plurality of stools located on each side of the support blocks. This can ensure that each individual stool is not too unwieldly. The rigid spacer may effectively be modular, i.e. may comprise a plurality of uniformly sized spacer modules that are mountable in the intermediate operating layer. The stools may be located as close to the sides of the blocks in order to leave free space therebetween for the jacking system.

In stage B of FIG. 3, the support structure is in an intermediate configuration where the height adjustment mechanism (hydraulic jacks 206) have been inserted and actuated to lift the upper support block 210 and compress the contact layer 214. In this state, the load is transferred from the rigid spacer to the height adjustment mechanism, which allows the rigid spacer to be removed.

In stage C of FIG. 3, the support structure is in a removal configuration. Here the lateral movement mechanism (e.g. roller tracks 208) are inserted into the intermediate operating layer, and the height adjustment mechanism (omitted for clarity) actuated to lower the upper set of components, which disengages the contact layer 214 from the ship and introduces a clearance gap 224. The upper set of components is lowered until it is support by the lateral movement mechanism, whereby it can be slid out from under the ship's hull. This sliding movement can be done manually.

It is important to understand the behaviour of the contact layer under compression in order to control effectively operation of the height adjustment mechanism. In one embodiment, the contact layer is formed from softwood, which exhibits a useful compression profile as discussed below. However, the invention need not be limited to the use of softwood. Other compressible material that exhibit a similar compression profile may be used.

Compression of the contact layer is utilised to increase the spacing between the base support block 204 and the upper support block, i.e. the height of the intermediate operating layer, to introduce a clearance gap that enables the rigid spacer to be inserted and removed.

Figure 4:
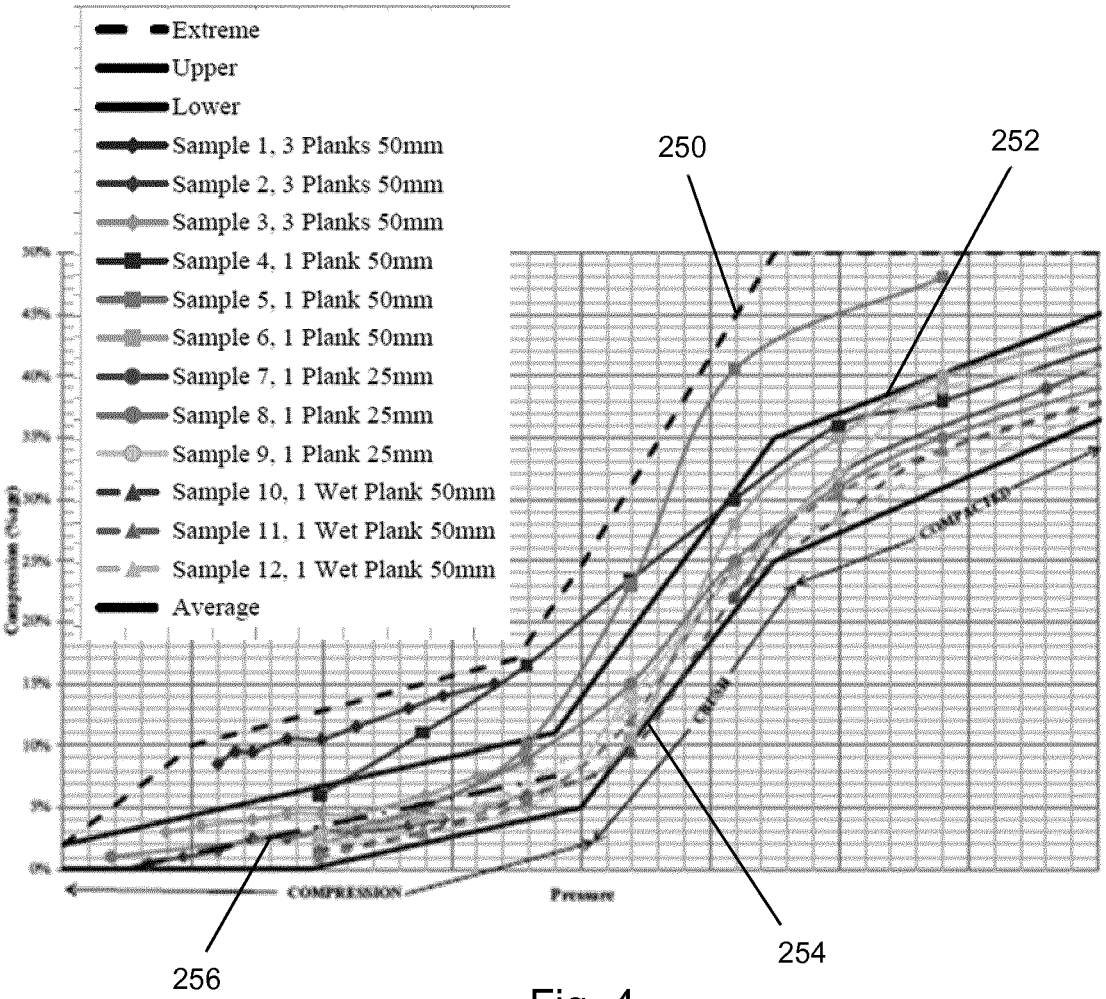
FIG. 4 is a graph illustrated compression profile for a different types of capper layer.

FIG. 4 is a graph showing the results of a series of softwood compression tests that were performed to obtain a typical compression profile for the material used in the contact layer 214. Samples of the standard timber that is used, with thickness varying between 25 mm and 100 mm, were tested. The effect of soaking in seawater was also taken into account.

The compression profile results for the various different shaped samples showed a correlation between pressure and strain. Using these results it was possible to plot compression profiles that correspond to a lower bound 254, an upper bound 252 and an extreme upper bound 250. These compression profiles can be used to create clear limits of the required pressure.

It can be seen that the plotted curves have an 'S' shape, so three modes of response can be defined each having a different rate of strain:

1. "Compression"—Small strain for given pressure.
2. "Crush"—Large strain for given pressure.
3. "Compacted"—Very little change for given pressure.

These modes of response may be indicative of elastic behaviour in the compression region and plastic behaviour in the crush region.

in the invention, the contact layer is configured to operate in the compression region during normal use. This region includes the range of pressures seen in conventional support structure, which typically lie in a range up to a limit of 165 tonne/$m^2$. Using wood as the material for the contact layer can provide additional benefits because it offers a compliant surface and promotes load-sharing between multiple support structures.

The crush region and compacted region may function as safety zone in case something goes wrong. For example, it there is an unexpected protrusion on the ship's undersurface, the block may become overloaded. In this situation, the wood in the contact layer may enter the crush region and effectively act as a fuse, i.e. by permitting significant movement without adding significantly more load. In more extreme error scenarios, the wood becomes "compacted" and has enormous strength in compression.

In normal use, the contact layer 214 in the support structure of the invention is configured to operate in the compression region, which is indicated by an average profile 256 in FIG. 256. In other words the pressure on the contact layer 214 is within the compression region both when the support structure is in the load bearing configuration (when the rigid spacer carries the load) and in the intermediate configuration where the height adjustment mechanism (jacking system) bears the load. The crush region is therefore reserved as a safety mechanism.

Figure 5:
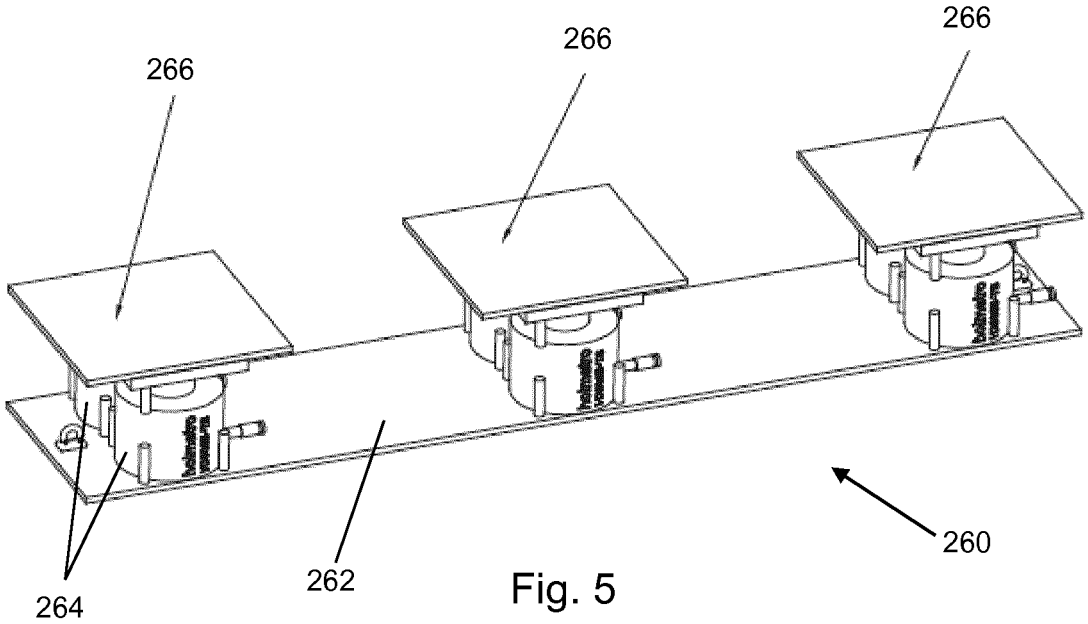
FIG. 5 is a perspective view of an intermediate jacking layer that is suitable for use in embodiments of the invention.

FIG. 5 shows a suitable height adjustment mechanism 260 for the support structure of the invention. The height adjustment mechanism 260 comprises a base plate 262 having a plurality of jacking assemblies (three in this example) mounted thereon. The base plate 262 is a flat elongate structure shaped to lie laterally on the top surface of the base support 204. The jacking assemblies are arranged in a lateral series along the base plate 262. Each jacking assembly comprises a pair of adjacent hydraulic jacks 264 operably connected to a top plate 266. The top plates 266 are arranged to engage the bottom surface of the upper support block 210 in use. Each jack 264 include a suitable actuation connection, but the fluid lines are omitted for clarity.

The jacks must produce the required load to overcome the forces acting on the upper support block 210 from the ship and to create compression of the contact layer 214 in order to increase the height of the intermediate operating layer, e.g. by 1 to 2 mm, to create a clearance gap for the removal of the rigid spacer.

The required capacity of the jacks can be calculated according to the following formula:

Required capacity of jacks=docking load+jacking load+safety margin

The docking load can be calculated using the known method specified in reference [1] listed below. This breaks the weight down in to sections between main watertight bulkheads. Overhang weight can be added back in as defined in reference [2]. The jacking load can be calculated using the compression profile of the contact layer discussed above. A target compression of 3 mm may be appropriate for most scenarios. As can be seen from the slope of the curves in the results, a 3 mm compression of a capper layer having a conventional thickness of 50 mm is a large percentage strain (6%) and would require a significant force to achieve. In order to alleviate this, the thickness (i.e. dimension in the load direction, which may be referred to as depth) of the contact layer can be selected appropriately. For example, to achieve a 3 mm compression for a contact layer that has a thickness of 200 mm requires only a 1.5% strain.

It may also be desirable for the support structure of the invention to operate in cases where they bear a relatively light load. It can be seen from the lower bound profile 254 in FIG. 4 that in some cases timber may exhibit almost no compression at low pressures. If such a piece of timber was used for a lightly loaded block there is a risk that it may require a large jacking load in order to achieve the clearance. To prevent this problem, the contact layer may be arranged to have a variable surface area. For lightly loaded blocks the surface area of the contact layer can therefore be reduced, thereby increasing the static docking pressure and reducing the risk that an excessive additional jacking load will be needed. The contact layer may comprise a plurality of removable module, e.g. planks or the like that can be selectively mounted on the upper surface of the upper support block (or on an intermediate timber layer, if present).

A suitable minimum jack capacity for the height adjustment mechanism may be equal to or greater than 200 tonnes, and may preferably be equal to or greater than 340 tonnes. In addition to providing this jack capacity, the height adjustment mechanism may need to have a footprint that is smaller (and in particular narrower) that the area of the top surface of the base support block. The total height of the jacking assemblies when in the closed (lowered) position may be selected to enable the height adjustment mechanism to be inserted and removed when the upper set of components is supported by the rigid spacer or the lateral movement mechanism.

Moreover, the stroke (range of vertical extension) of the jacking assemblies must enable the top plates to move between a lower position that is under the top surface of the lateral movement mechanism and an upper position that is higher than the top surface of the rigid spacer. The required stroke may be made up of the following elements (from top to bottom):

- safety margin to avoid jack over-extension,
- target compression of contact layer,
- buffer to accommodate contact layer decompression on unloading,
- target disengagement clearance gap (i.e. desired distance between contact layer and ship undersurface in the removal configuration),
- jack removal clearance (i.e. desired distance below upper surface of lateral movement mechanism), and
- lower safety margin.

In the embodiment shown in FIG. 5, each jacking assembly was formed from a pair of jacks, each jack having a 60 tonne capacity and a 50 mm stroke. In order to prevent overloading of the support blocks, these jacks were de-rated to a 37 tonne capacity, whereby the six jacks in the three jack assemblies provide a total jacking capacity of about 220 tonnes.

As discussed above, the support structure of the invention may be able to utilise existing dock furniture, in particular the known type of reinforced concrete dock blocks. Using existing equipment, the support structure of the invention may be capable of supporting loads of up to 220 tonnes. However, it has been predicted that during the docking of some ships loads in region of 340 tonnes may need to be accommodated. These higher loads may be supported by the conventional support structure (e.g. as shown in FIG. 1), but that means that the advantages of the invention are lost in the high load regions.

The limiting factor on the load capacity of the support structure discussed in the above embodiments may be the conventional dock block. Thus, to increase the load capacity of the structure, the disclosure herein contemplates a new support block structure that is stronger than the conventional Type 1 blocks. Having a stronger block for the base support block and the upper support block would allow all the support structures for a vessel to be removed quickly and efficiently during a normal docking period.

An additional advantage of increasing the load capacity of the support structure is that it may enable hydrostatic testing of tanks on the vessel to be performed during the docking period. Currently such testing is carried out while the vessel is afloat and therefore may lie on the critical path for return of the ship to service. Stronger support blocks may be arranged to withstand the high loads from the full tanks and facilitate testing in dock.

Whilst it is recognised that reinforced concrete is a preferred material for dock furniture, due to its corrosion resistance, general toughness and good operational experience in existing support blocks, the inventors have recognised that a prohibitive amount of reinforcing bars would be required in order for this material to meet the demand for loads of up to 400 tonnes. Accordingly, the present disclosure presents a stronger support block that is fabricated from steel or other workable material having a structural properties capable of supporting the desired load.

There are operational advantages in being able to use the new type of blocks interchangeably with the conventional Type 1 blocks, e.g. in support structures that are not required to bear very high loads. Accordingly, the steel support block may be configured to have the same dimensions and a similar weight (i.e. no more than 4 tonnes) as the Type 1 support blocks.

Figure 6:
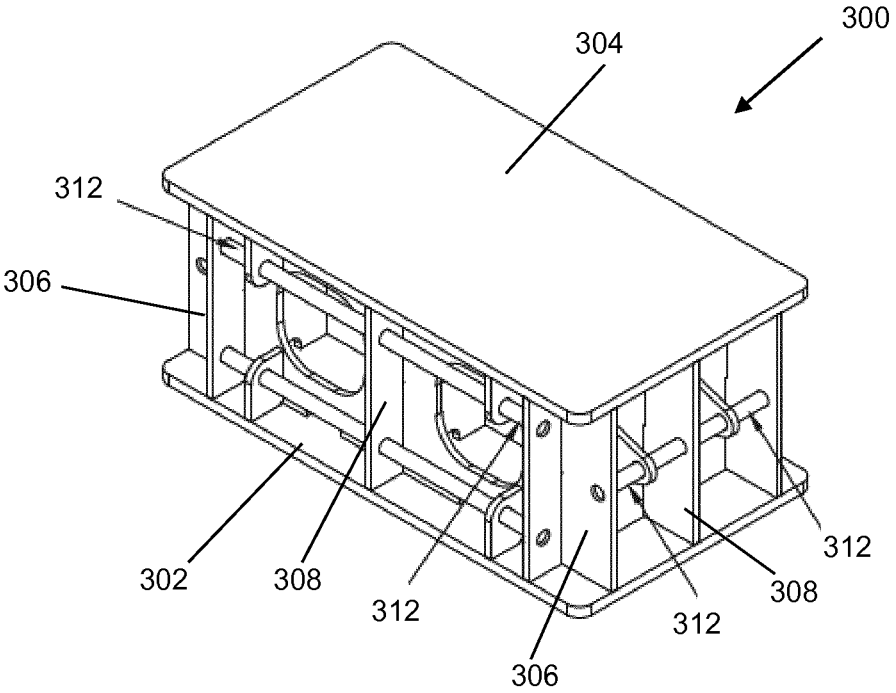
FIG. 6 is a perspective view of a support block suitable for use in a dry dock vessel supporting apparatus that is a second embodiment of the invention.

FIG. 6 is a perspective view of a support block 300 that is suitable for use in a support structure according to the invention. It can be used in place of either or both of the base support block 204 and upper support block 210 discussed above. The support block 300 comprises a lower plate 302 and an upper plate 304 that form the top and bottom surfaces of the block. The plates may provide robust and planar upper and lower surface to facilitate stacking and uniform application of forces exerted on them during the removal process. The plates 302, 304 may be rolled plates of steel. The plates are secured together by a network of panels (which may also be sheets of steel) which form a criss-cross pattern to provide the required strength in the load direction. The network of panels may comprise a plurality of panels 308 that extend in the lateral direction and which form angled corner struts 306 with panel that extend in a cross-lateral direction. In general, the structure is open and accessible to allow for inspection and re-preservation throughout its life cycle.

A number of rods may be mounted on the panels to form a set of lifting points 312 to facilitate handling of the support block 300. For example, the support block may be manipulated using dockside cranes, mobile cranes, forklifts and side loaders.

Figure 7:
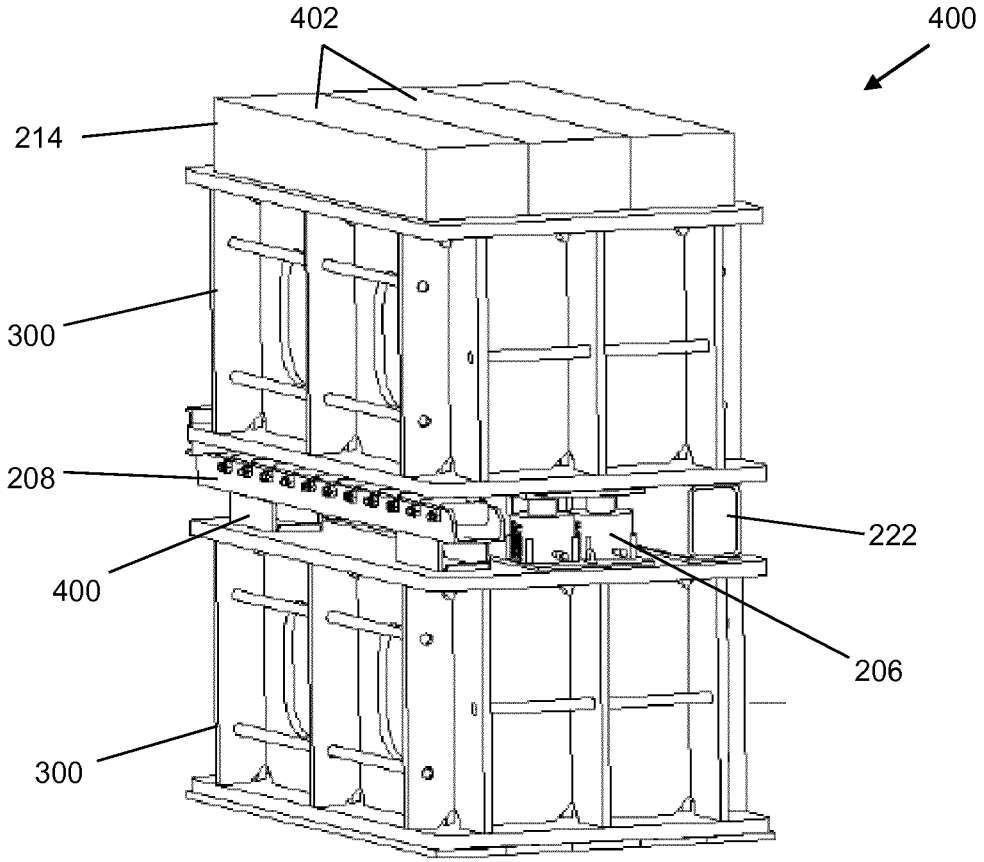
FIG. 7 is a perspective view of a dry dock vessel supporting apparatus that is a second embodiment of the invention.

FIG. 7 shows a schematic perspective view of a support structure 400 that make use of the support block shown in FIG. 6. The same reference numbers are used for elements that have already been described. It may be noted that in this example, there is no intermediate timber layer and the contact layer 214 comprises three planks 402. In this drawing, the intermediate operating layer has a lateral movement mechanism on one side of the height adjustment mechanism 206 and a rigid spacer 222 on the other side. This is to illustrate the components that can be positioned in the intermediate operating layer.

Taking into account the design requirements and constraints, the main dimensions for the support structure 400 and its desired loads are summarised below Overall structure height: 1.7 m
Width 1.0 m
Length 1.8 m
Maximum overall load: 400 tonnes
Maximum transferred ground load: 222 tonnes/$m^2$ The adverse conditions from the harsh working environment have been highlighted above. The new support blocks 300 are capable of withstanding repeated submergence in sea water, exposure in overspray and other contaminants (oil, solvent, etc.) and have a reasonable resistance to damage under shot blast operations.

The support structure of the invention develops an approach to dock block removal that uses jacking, rather than traditional methods. The support structure can assist in reducing the cost and time associated with the inspection and re-preservation of the full extent of ship's outer bottoms. This provides a benefit in the refitting of ships and also allows all fouling to be removed; thus improving the ship's speed or fuel efficiency.

The above general disclosure and description of specific embodiments will make available to one skilled in the relevant art further adaptations and modifications which fall within the general concept of the present invention. Such adaptations and modifications may include combinations of features presented in different embodiments described above, and such combinations are to be considered as expressly disclosed herein.

Although the embodiments of the invention discussed above are described in the context of dry docks, the support structure of the invention may be used in many other areas. For example, the support structure of the invention may be used in floating docks, ship lifts, railway systems and other hard standing areas.

While various embodiments of the present invention have been described above, it should be understood that they have been presented by way of example, and not limitation. It would be apparent to one skilled in the relevant art that various changes in form and detail could be made therein without departing from the scope of the invention as defined in the claims.

REFERENCES

[1] SSCP 23, Volume 1, Original 12.89—'Design of Surface Ship Structures', pp 4.11-4.12

[2] Lloyd's Register—'Rules and Regulations for the Classification of Naval Ships', January 2015. Volume 1, Part 3, Chapter 5, Section 10.4.8

The invention claimed is:

1. A support structure comprising:

a base support block;

an upper support block mounted on an upper surface of the base support block via an intermediate operating layer;

a compressible contact layer supported on an upper surface of the upper support block;

a height adjustment mechanism mountable in the intermediate operating layer; and a rigid spacer mountable in the intermediate operating layer;

wherein the intermediate operating layer is adjustable between:

a load bearing configuration in which the rigid spacer is mounted in the intermediate operating layer to transfer a load on the upper support block to the base support block, an intermediate configuration in which the height adjustment mechanism is mounted in the intermediate operating layer and operable to lift the upper support block to introduce a clearance gap that permits insertion and removal of the rigid spacer, the height adjustment mechanism being configured to bear the load on the upper support block in the intermediate configuration and to compress the contact layer to form the clearance gap.

2. A support structure according to claim 1, wherein the base support block and upper support block have substantially the same size and weight.

3. A support structure according to claim 1, wherein the base support block and/or the upper support block comprises a cuboidal mass of reinforced concrete with a plated surface at an interface with the intermediate operating layer.

4. A support structure according to claim 1, wherein the base support block and/or the upper support block comprises:

a lower plate that forms the bottom surface of the block;

an upper plate that forms the top surface of the block; and a load bearing frame that connects the lower plate to the upper plate.

5. A support structure according to claim 1, wherein the contact layer is formed from a material that is resiliently compressible.

6. A support structure according to claim 1, wherein the contact layer has a variable surface area.

7. A support structure according to claim 1, wherein the height adjustment mechanism comprises a jacking assembly.

8. A support structure according to claim 7, wherein the height adjust mechanism comprises a series of jacking assemblies mounted laterally along the intermediate operating layer, the jacking assemblies having a combined load capacity equal to or greater than a load capacity of the support structure in the load bearing configuration.

9. A support structure according to claim 7, wherein the jacking assembly comprises one or more hydraulic jacks.

10. A support structure according to claim 1, wherein the height adjustment mechanism is operable to adjust the intermediate operating layer between the intermediate configuration and a removal configuration in which the upper support block is lowered to permit removal of the upper support block.

11. A support structure according to claim 10 comprising a lateral movement mechanism mountable in the intermediate operating layer, wherein, in the removal configuration, the lateral movement mechanism is mounted in the intermediate operating layer and the upper support block is operably connected to the lateral movement mechanism to permit relative lateral movement between the upper support block and base support block.

12. A support structure according to claim 11, wherein the lateral movement mechanism is operable to facilitate manual sliding of the upper support block relative to the base support block.

13. A support structure according to claim 11, wherein the lateral movement mechanism comprises a set of rollers secured to the base support block.

14. A support structure according to claim 13, wherein the set of rollers comprises a pair of laterally extending roller tracks mounted at opposite sides of a top surface of the base support block.

15. A support structure according to claim 10 comprising a storage table positionable laterally adjacent the base support block to receive the upper support block during relative movement between the upper support block and base support block in the removal configuration.

16. A support structure according to claim 1, wherein the rigid spacer comprises a plurality of rigid struts locatable in the intermediate operating layer.

17. A support structure according to claim 1 comprising an intermediate timber layer between the upper support block and the contact layer.

18. A method of introducing a support structure beneath a vessel, the support structure comprising: a base support block; an upper support block mountable on an upper surface of the base support block via an intermediate operating layer; a compressible contact layer supported on an upper surface of the upper support block; a height adjustment mechanism mountable in the intermediate operating layer; and a rigid spacer mountable in the intermediate operating layer, the method comprising:

locating the base support block beneath a location on an undersurface of the vessel that is to be contacted by the support structure;

mounting the height adjustment mechanism in the intermediate operating layer on the base support block;

positioning the upper support block in a mounting position on the base support block;

operating the height adjustment mechanism to lift the upper support block into contact with the undersurface of the vessel and introduce a separation distance between the base support block and upper support block for receiving the rigid spacer, wherein lifting the upper support block into contact with the undersurface of the vessel includes transferring a load from the vessel onto the height adjustment mechanism and compressing the contact layer;

inserting the rigid spacer into the intermediate operating layer;

operating the height adjustment mechanism to lower the upper support block on to the rigid spacer, whereby the rigid spacer transfers a load on the upper support block to the base support block.

19. A method of removing a support structure from beneath a vessel, the support structure comprising: a base support block; an upper support block mounted on an upper surface of the base support block via an intermediate operating layer; a compressible contact layer supported on an upper surface of the upper support block; a height adjustment mechanism mountable in the intermediate operating layer; and a rigid spacer mounted in the intermediate operating layer to transfer a load from the vessel on the upper support block to the base support block, the method comprising:

mounting the height adjustment mechanism in the intermediate operating layer on the base support block;

operating the height adjustment mechanism to lift the upper support block into contact with the undersurface of the vessel and introduce a clearance gap above the rigid spacer, wherein lifting the upper support block into contact with the undersurface of the vessel includes transferring a load from the vessel onto the height adjustment mechanism and compressing the contact layer;

removing the rigid spacer from the intermediate operating layer;

operating the height adjustment mechanism to lower the upper support block and create a gap between the contact layer and the undersurface of the vessel; and moving the upper support block relative to the base support block away from its mounting position on the base support block.

* * * * *